US011090969B2

(12) United States Patent
Kageyama et al.

(10) Patent No.: US 11,090,969 B2
(45) Date of Patent: Aug. 17, 2021

(54) MECHANICAL PENCIL

(71) Applicants: Kotobuki & Co., Ltd., Kawagoe (JP); Pica-Marker Vermögens GmbH & Co. KG, Kirchehrenbach (DE)

(72) Inventors: Hidehei Kageyama, Kawagoe (JP); Tadao Odaka, Kawagoe (JP); Toshikazu Sasaki, Kawagoe (JP)

(73) Assignees: KOTOBUKI & CO., LTD., Kawagoe (JP); PICA-MARKER VERMÖGENS GMBH & CO. KG, Kirchehrenbach (DE)

( * ) Notice: Subject to any disclaimer, the term of this patent is extended or adjusted under 35 U.S.C. 154(b) by 0 days.

(21) Appl. No.: 16/725,646

(22) Filed: Dec. 23, 2019

(65) Prior Publication Data

US 2021/0187994 A1 Jun. 24, 2021

(51) Int. Cl.
*B43K 21/22* (2006.01)
*B43K 24/08* (2006.01)

(52) U.S. Cl.
CPC ..... *B43K 21/22* (2013.01); *B43K 24/082* (2013.01)

(58) Field of Classification Search
CPC ..... B43K 21/22; B43K 24/08; B43K 24/082
See application file for complete search history.

(56) References Cited

U.S. PATENT DOCUMENTS

| | | | | |
|---|---|---|---|---|
| 2,340,665 | A * | 2/1944 | Doyle | B43K 21/22 401/65 |
| 2,510,312 | A * | 6/1950 | Hedler | B43K 21/20 401/65 |
| 2,514,610 | A * | 7/1950 | Schweitzer | B43K 21/22 401/67 |
| 4,478,529 | A * | 10/1984 | Morio | B43K 21/22 401/53 |
| 5,184,908 | A * | 2/1993 | Yamamoto | B43K 24/084 401/109 |
| 2004/0037609 | A1* | 2/2004 | Kageyama | B43K 29/02 401/52 |
| 2008/0019761 | A1* | 1/2008 | Taniguchi | B43L 19/0018 401/190 |
| 2018/0250977 | A1 | 9/2018 | Wakayama et al. | |

FOREIGN PATENT DOCUMENTS

EP 1 151 874 A1 11/2001

OTHER PUBLICATIONS

Extended European Search Report dated Apr. 16, 2021 for European Patent Application No. 20208072.7-1014.

* cited by examiner

*Primary Examiner* — J C Jacyna
(74) *Attorney, Agent, or Firm* — McGinn IP Law Group, PLLC

(57) ABSTRACT

A mechanical pencil includes a writing lead, a chuck that chucks the writing lead and feeds the writing lead forward, and a shaft tube for housing the writing lead and the chuck. When a click operation for feeding the chuck forward is performed, a jet stream flowing forward is generated inside the shaft tube.

17 Claims, 5 Drawing Sheets

MECHANICAL PENCIL

FIELD

The embodiments discussed herein relate to mechanical pencils.

BACKGROUND

A conventional writing instrument includes a chuck configured to sandwich and to chuck a writing lead for a writing instrument. The chuck includes a first chuck pawl which comes into a point contact or a line contact with the writing lead for the writing instrument to press the writing lead for the writing instrument so as to apply first contact stress to the writing lead for the writing instrument, and a second chuck pawl which presses the writing lead for the writing instrument so as to apply, to the writing lead for the writing instrument, second contact stress that is lower than the first contact stress, and the first contact stress applied by the first chuck pawl to the writing lead for the writing instrument is configured such that, when a prescribed impact is applied to the writing lead for the writing instrument, a contact portion of the writing lead for the writing instrument subjected to the first contact stress fractures and absorbs the prescribed impact (see, e.g., paragraphs 0007 to 0008 in US Patent Application Publication No. 2018-250977A1, hereinafter, referred as Patent Document 1.) In the writing instrument disclosed in Patent Document 1, a writing instrument capable of reducing impact transmitted to a writing lead for a writing instrument from the outside can be provided.

However, it has been desired to provide a mechanical pencil capable of chucking the writing lead with higher reliability than before.

SUMMARY

In one exemplary aspect of the present invention, a mechanical pencil includes a writing lead, a chuck that chucks the writing lead and feeds the writing lead forward, and a shaft tube for housing the writing lead and the chuck, wherein, when a click operation for feeding the chuck forward is performed, a jet stream flowing forward is generated in the shaft tube.

In the above-mentioned exemplary embodiment, a mechanical pencil capable of chucking the writing lead with higher reliability than before can be provided.

The present invention will become more fully understood from the detailed description given hereinbelow. The other applicable fields will become apparent with reference to the detailed description given hereinbelow. However, the detailed description and the specific exemplary embodiment are illustrated of desired embodiments of the present invention and are described only for the purpose of explanation. Various changes and modifications will be apparent to those ordinarily skilled in the art on the basis of the detailed description. The applicant has no intention to give to the public any disclosed embodiments. Among the disclosed changes and modifications, those which may not literally fall within the scope of the present claims constitute, therefore, a part of the present invention in the sense of doctrine of equivalents.

BRIEF DESCRIPTION OF DRAWINGS

The exemplary aspects of the invention will be better understood from the following detailed description of the exemplary embodiments of the invention with reference to the drawings in which.

DESCRIPTION OF EXEMPLARY EMBODIMENTS

Figure 1:
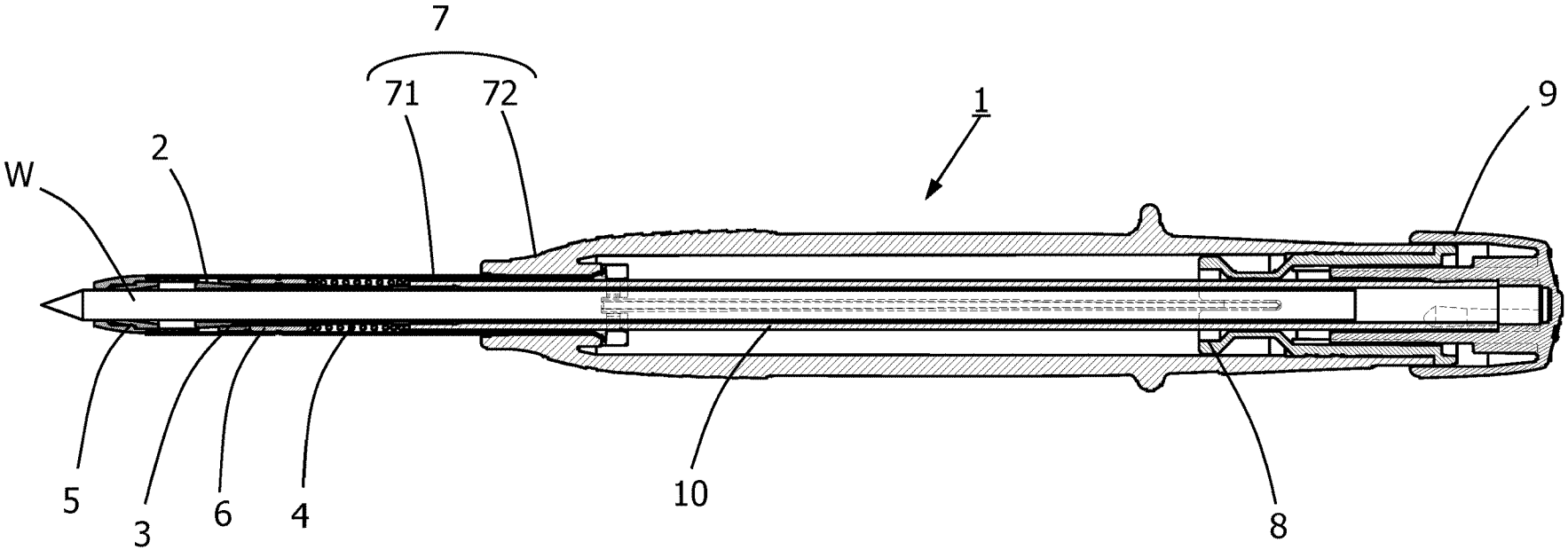
FIG. 1 is a cross-sectional view of a mechanical pencil according to an exemplary embodiment.

FIG. 1 is a cross-sectional view of a mechanical pencil 1 according to an exemplary embodiment. The mechanical pencil 1 includes a writing lead W and, as will be described hereinafter, a chuck 2, a chuck ring 3, a chuck spring 4, a writing lead holder 5, a metal stopper 6, a shaft tube 7, a spacer 8, a click button 9, and a writing lead tube 10. In the following description, a side of the mechanical pencil 1 where the chuck 2 is disposed along a longitudinal central axis (referred to as "the axis") is referred to as "the front" of the mechanical pencil 1 and an opposite side is referred to as "the rear".

Figure 2:
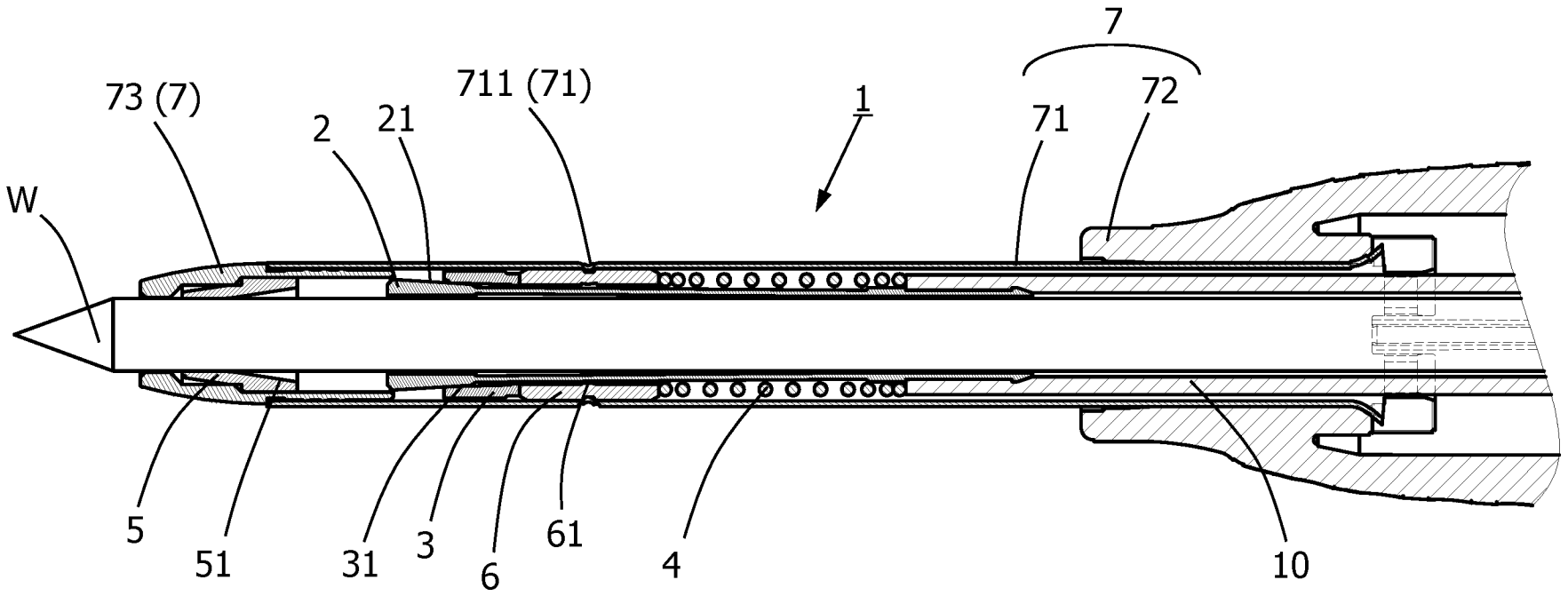
FIG. 2 is an enlarged cross-sectional view of a front part of the mechanical pencil of FIG. 1.

FIG. 2 is an enlarged cross-sectional view of a front part of the mechanical pencil 1. The chuck 2 formed in a substantially tubular shape is disposed on an outer periphery of the writing lead W. An outer peripheral surface of a rear end of the chuck 2 is fitted into an inner peripheral surface of a front end of the writing lead tube 10 formed in a tubular shape. A front end part and a central part of the chuck 2 are each divided in a circumferential direction so as to form a plurality of protruding pieces. Each of the central parts of the chuck 2 elastically supports the respective front end parts of the chuck 2 so that the front end parts of the chuck 2 can each move in a radial direction. The front end parts of the chuck 2, in a free state thereof, are each configured to separate from the writing lead W, radially outside the writing lead W.

As the chuck spring 4, which is described hereinafter in detail, urges the chuck 2 rearward, the chuck 2 is retracted and outer peripheral surfaces of the respective front end parts of the chuck 2 are fitted into an inner peripheral surface of the substantially tubular chuck ring 3 disposed behind the chuck 2. Therefore, the front end parts of the chuck 2 that are fitted into the chuck ring 3 push the writing lead W from the radially outer side toward the radially inner side, to chuck the writing lead W. On the other hand, as a result of a click operation on the click button 9 (see FIG. 1) which is described hereinafter in detail, the chuck ring 3 moves forward by a predetermined distance while the chuck 2 fitted thereto chucks the writing lead W. As a result of the chuck 2 and the chuck ring 3 moving forward, a front surface of the chuck ring 3 comes into abutment with a rear end surface of a tip fitting 73 of the shaft tube 7 formed in a substantially tubular shape, and the chuck ring 3 is detached to the rear end of the chuck 2. At this moment, the chuck 2 returns to a free state thereof, whereby the writing lead W becomes released from being chucked by the chuck 2. In this manner, the writing lead W is chucked by the chuck 2 and fed forward.

The writing lead holder 5, made of an elastomer and formed in a substantially tubular shape, is mounted on an inner peripheral surface of the tip fitting 73 of the shaft tube 7. An inner peripheral surface of the writing lead holder 5 comes into contact with an outer peripheral surface of the writing lead W from the radially outer side, to hold the writing lead W. This prevents the writing lead W from moving freely in the axial direction when the writing lead W is released from being chucked by the chuck 2. An outer peripheral surface of a rear part of the tip fitting 73 of the shaft tube 7 is fitted into an inner peripheral surface of a front part of a front tube 71 of the substantially tubular shaft tube 7 made of a metal.

The substantially tubular metal stopper 6 made of a metal is mounted on an inner peripheral surface of the front tube 71 of the shaft tube 7 located behind the tip fitting 73 of the shaft tube 7. In the present exemplary embodiment, the metal stopper 6 is integrally fixed to the front tube 71 by a swaging processing in which the front tube 71 of the shaft tube 7 and the metal stopper 6 are pressed together from the radially outer side to the radially inner side of the outer peripheral surface 711 of the front tube 71 (refer to FIG. 2.) According to this configuration, the metal stopper 6 can integrally be fixed to the front tube 71 with a high productivity. The swaging processing may be performed over the entire circumference of the front tube 71 in the circumferential direction. In this case, for example, by performing the swaging processing using a roller circling on the outer peripheral surface of the front tube 71 in the circumferential direction, the metal stopper 6 can integrally be fixed to the front tube 71 at a high productivity.

The chuck spring 4, including a coil spring for urging the chuck 2 rearward, is disposed behind the metal stopper 6. A front end surface of the chuck spring 4 comes into abutment with a rear end surface of the metal stopper 6, and a rear end surface of the chuck spring 4 comes into abutment with a front end surface of the writing lead tube 10. The chuck spring 4 urges the writing lead tube 10 rearward with respect to the metal stopper 6, and thereby urges the chuck 2 rearward with respect to the metal stopper 6, the chuck 2 being fitted into a front end part of the writing lead tube 10. Being urged by the chuck spring 4, the chuck 2 is retracted, and consequently a rear end surface of the chuck ring 3 comes into abutment with a front end surface of the metal stopper 6, whereby the chuck 2 and the chuck ring 3 are fitted to each other.

The outer peripheral surface of the rear part of the front tube 71 of the shaft tube 7 is fitted into an inner peripheral surface of a front part of a rear tube 72 of the shaft tube 7. A rear end part of the front part of the rear tube 72 of the shaft tube 7 is formed into a double tube. An inner peripheral surface of an inner tube of the double tube in the front part of the rear tube 72 of the shaft tube 7 is in the shape of a hook protruding radially inward. When the rear part of the front tube 71 of the shaft tube 7 is mounted on the front part of the rear tube 72 of the shaft tube 7, a rear end part of the front tube 71 of the shaft tube 7 becomes plastically deformed so as to open radially outward, by pressing the rear end part of the front tube 71 of the shaft tube 7 forward in the axial direction, from behind, by using a conically-shaped punch. The plastically deformed rear end surface of the front tube 71 of the shaft tube 7 comes into engagement with a front end surface of the hook-shaped protruding part of the inner tube of the double tube at the front part of the rear tube 72 of the shaft tube 7. In this manner, the front tube 71 of the shaft tube 7 is fixed to the rear tube 72 of the shaft tube 7 so as to not be able to move in a front-rear direction. The assembled front tube 71 and rear tube 72 are integrated to configure the shaft tube 7.

Figure 3:
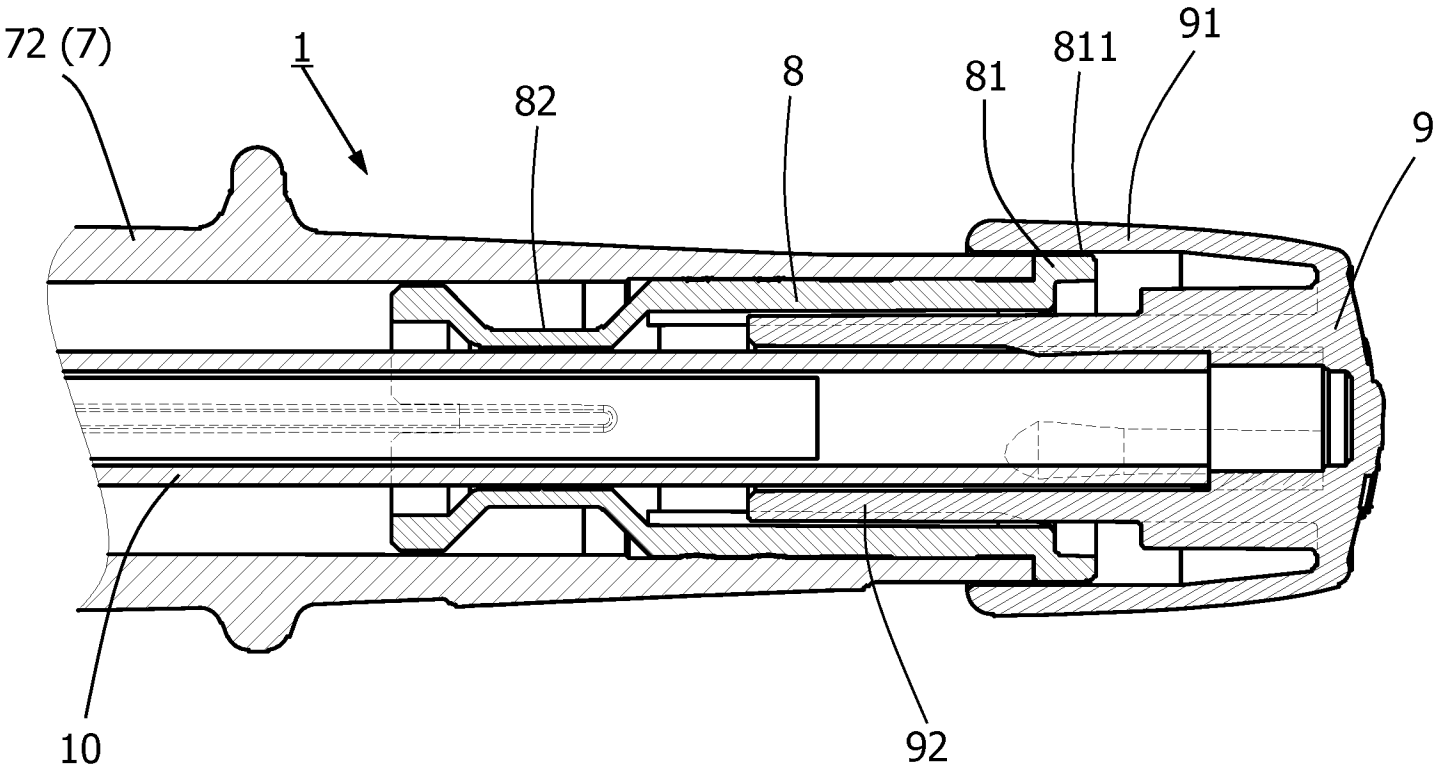
FIG. 3 is an enlarged cross-sectional view of a rear part of the mechanical pencil of FIG. 1.

FIG. 3 is an enlarged cross-sectional view of a rear part of the mechanical pencil 1. The spacer 8 formed into a substantially tubular shape is assembled on a rear end part of the rear tube 72 of the shaft tube 7. A seal 81 protruding radially outward is formed at a rear end part of the spacer 8. A front end surface of the seal 81 of the spacer 8 comes into abutment with the rear end surface of the rear tube 72 of the shaft tube 7. A diaphragm 82 having an inner diameter smaller than that of parts of the spacer 8 other than a front part thereof is formed at the front part of the spacer 8. An inner peripheral surface of the diaphragm 82 of the spacer 8 comes close to an outer peripheral surface of the writing lead tube 10 that covers the outer peripheral surface of the writing lead W, thereby forming an annular flow path (i.e., a "second flow path" described hereinafter in detail) between the inner peripheral surface of the diaphragm 82 and the writing lead tube 10.

The click button 9 formed in the shape of a substantially double tube with a bottom surface is assembled on a rear end part of the writing lead tube 10. An inner peripheral surface of an inner tube 92 of the click button 9 is fitted detachably to the outer peripheral surface of the writing lead tube 10. An outer peripheral surface of the inner tube 92 of the click button 9 comes close to an inner peripheral surface of the spacer 8 that is located in front of the seal 81 of the spacer 8, thereby forming an annular flow path (i.e., a "first flow path" described hereinafter in detail) between the outer peripheral surface of the inner tube 92 of the click button 9 and the inner peripheral surface of the spacer 8. An inner peripheral surface of an outer tube 91 of the click button 9 comes close to the outer peripheral surfaces of the rear tube 72 of the shaft tube 7 and the seal 81 of the spacer 8, thereby forming an annular flow path ("an air intake port", described hereinafter in detail) therebetween.

Figure 4:
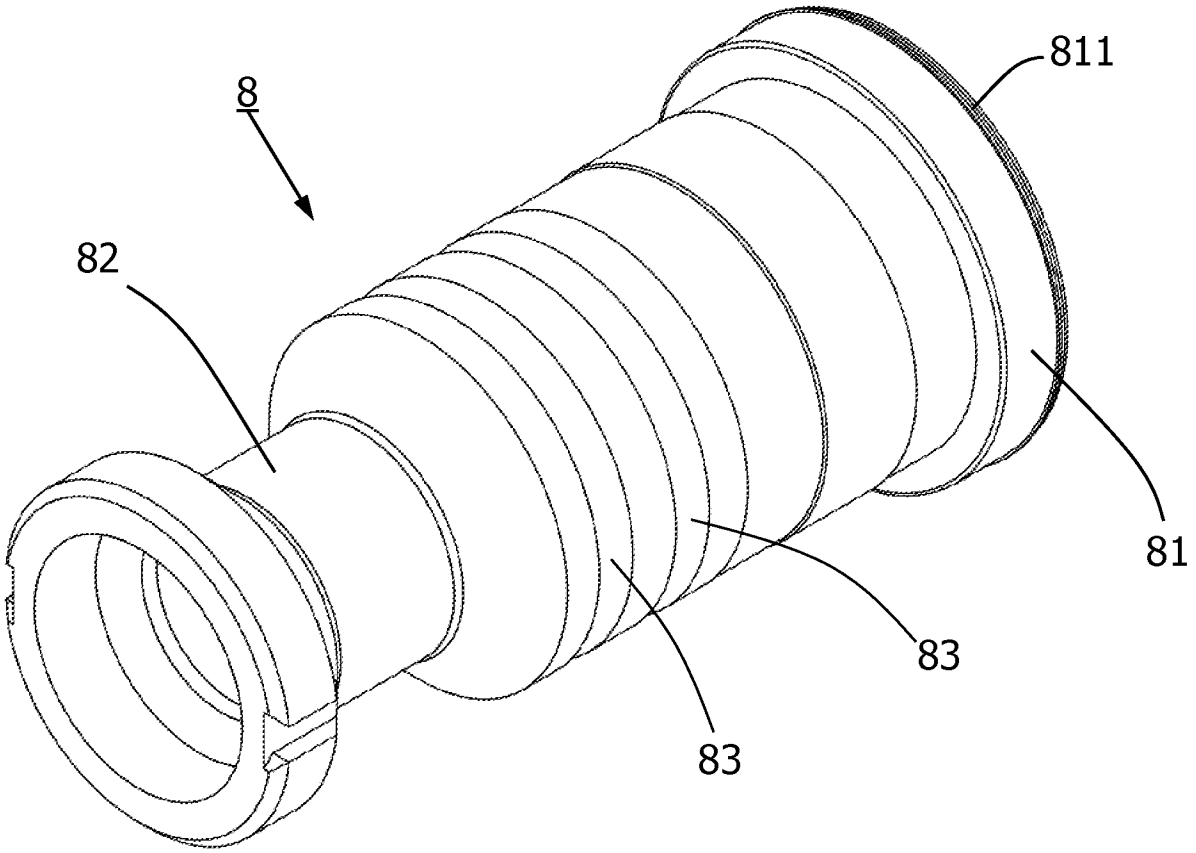
FIG. 4 is an enlarged perspective illustration of a spacer of the mechanical pencil of FIG. 1.
Figure 5:
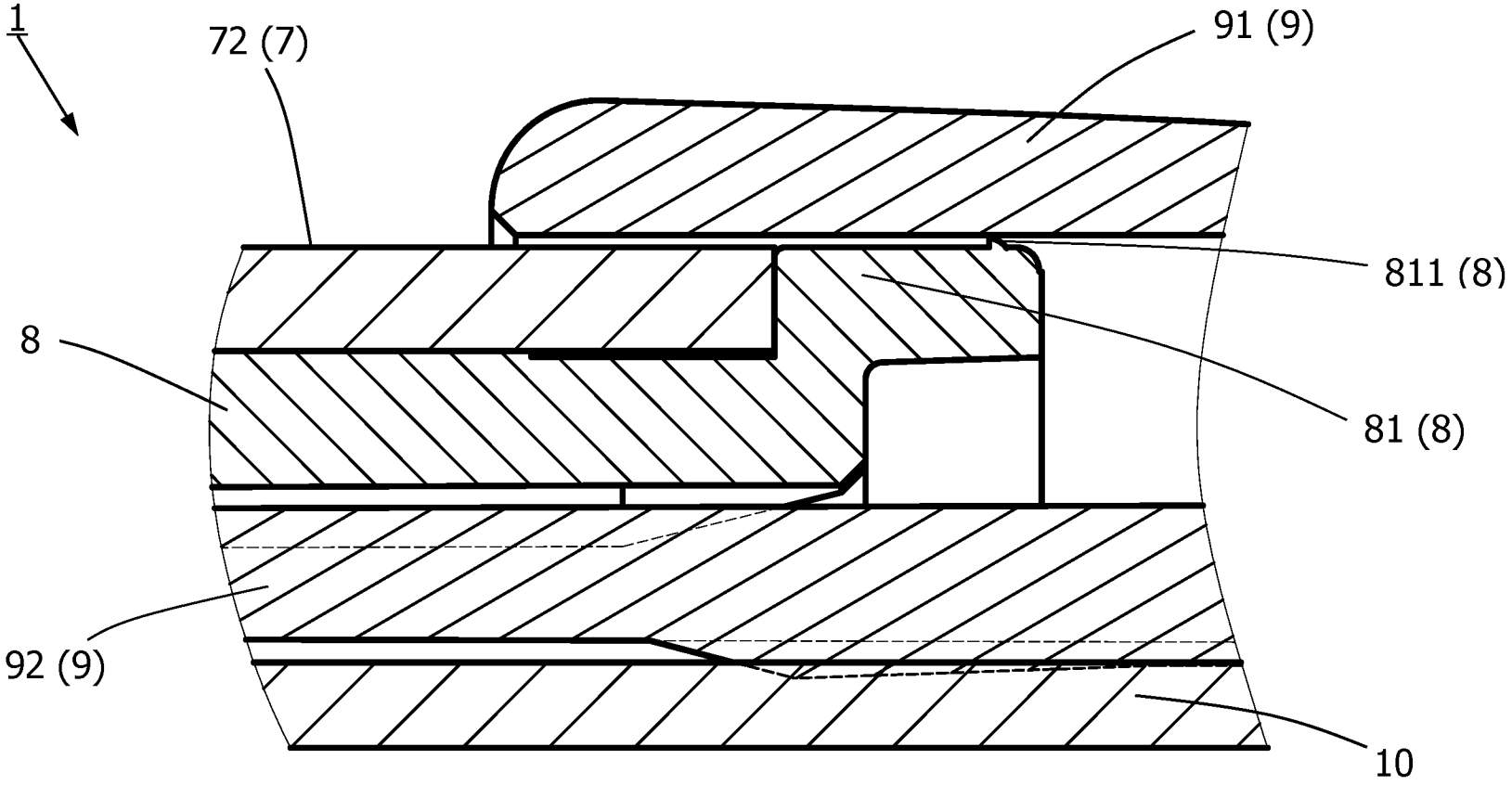
FIG. 5 is an enlarged cross-sectional view of a rear end part of the spacer of the mechanical pencil of FIG. 1.

FIG. 4 is an enlarged perspective illustration of the spacer 8 of the mechanical pencil 1. FIG. 5 is an enlarged cross-sectional view of a rear end part of the spacer 8 of the mechanical pencil 1. Two annular ribs 83 protruding radially outward are formed on the outer peripheral surface of the spacer 8. By fitting the ribs 83 of the spacer 8 to the inner peripheral surface of the rear tube 72 of the shaft tube 7, the spacer 8 is assembled on the rear tube 72 of the shaft tube 7. An annular protrusion 811 protruding radially outward is formed on an outer peripheral surface of a rear end part of the seal 81 of the spacer 8. An outer peripheral surface of the annular protrusion 811 of the seal 81 of the spacer 8 comes close to the inner peripheral surface of the outer tube 91 of the click button 9, thereby forming the annular flow path (i.e., the "air intake port" described hereinafter in detail) between the outer peripheral surface of the annular protrusion 811 and the inner peripheral surface of the outer tube 91 of the click button 9. The cross-sectional shape of the annular protrusion 811 of the seal 81 of the spacer 8 has, on a front surface thereof, a wall surface perpendicular to the axis, and is configured to have a convex curved surface that decreases in radially outward projection amount toward the rear. This configuration can form, between the inner peripheral surface of the outer tube 91 of the click button 9 and the annular protrusion 811 of the seal 81 of the spacer 8, the annular flow path (i.e., air intake port) that can take in outside air by preventing the entry of a foreign matter from the outside and making it difficult to cause clogging by the foreign matter. Therefore, the present exemplary embodiment can provide the mechanical pencil 1 which, even when used outdoors such as in a building site, can prevent the entry of the foreign matter into the mechanical pencil 1 from the outside and chuck the writing lead W with higher reliability than before.

The mechanical pencil 1 is configured in such a manner that when a user performs the click operation by clicking on the click button 9, a jet stream, flowing forward, is generated inside the shaft tube 7.

As a result of this click operation, the click button 9 moves forward, thereby compressing the air inside a first chamber formed by the seal 81 of the spacer 8 and the outer tube 91, the inner tube 92, and a rear wall of the click button 9. The flow passage area (i.e., cross-sectional area perpendicular to the axis) of the front annular flow path (referred to as the "first flow path" hereinafter) of the first chamber, formed between the inner peripheral surface of the spacer 8 and the outer peripheral surface of the inner tube 92 of the click button 9, is formed to be wider than the flow passage area (i.e., cross-sectional area) of the annular air intake port. Thus, when the click operation is performed, the air inside the first chamber mainly forms a first jet stream that flows forward through the annular first flow path. In the first chamber, the airtightness between the click button 9 and the shaft tube 7 is enhanced by the seal 81 of the spacer 8. When the click button 9 is released from the click operation performed by the user, the click button 9 is retracted by an urging force of the chuck spring 4, and outside air is introduced to the first chamber from the annular air intake port.

The first jet stream ejected from the first chamber flows into a second chamber formed by a rear end surface of the diaphragm 82 of the spacer 8, the outer peripheral surface of the writing lead tube 10, and a front end surface of the inner tube 92 of the click button 9. The volume of the second chamber is configured to be smaller than the volume of the first chamber. As the click button 9 moves forward, the volume of the second chamber is reduced. The air in the second chamber forms a second jet stream flowing forward from the second chamber through the annular flow path (referred to as the "second flow path" hereinafter) between the inner peripheral surface of the diaphragm 82 of the spacer 8 and the outer peripheral surface of the writing lead tube 10. Since the flow passage area (i.e., the cross-sectional area perpendicular to the axis) of the second flow path is configured to be smaller than the flow passage area (i.e., the cross-sectional area) of the first flow path, the flow velocity of the second jet stream is accelerated more than the flow velocity of the first jet stream. By configuring the volume of the second chamber to be smaller than the volume of the first chamber and configuring the flow passage area of the second flow path to be smaller than the flow passage area of the first flow path as described above, the second jet stream having a high flow velocity can be formed. The second jet stream having a high flow velocity forms a main jet stream that reaches the front end of the mechanical pencil 1.

The main jet stream flows forward in the shaft tube 7 through an annular flow path formed between the outer peripheral surface of the writing lead tube 10 and the inner peripheral surface of the shaft tube 7. Once the main jet stream reaches the metal stopper 6, the main jet stream passes through an annular flow path (i.e., an "acceleration flow path" described hereinafter in detail) formed between an inner peripheral surface of the metal stopper 6 and outer peripheral surfaces of the central parts of the chuck 2. An annular protrusion 61 (see FIG. 2) that protrudes radially inward is formed on the inner peripheral surface of the metal stopper 6 by the swaging processing described above. The flow passage area (i.e., cross-sectional area perpendicular to the axis) of the annular flow path (i.e., the acceleration flow path) formed between an inner peripheral surface of the annular protrusion 61 of the metal stopper 6 and the outer peripheral surface of the writing lead tube 10 is configured to be smaller (narrower) than the flow passage area (i.e., cross-sectional area) of the second flow path. Thus, the flow velocity of the main jet stream is accelerated as the main jet stream passes through the annular protrusion 61 (i.e., the acceleration flow path) of the metal stopper 6. Moreover, in the present exemplary embodiment, a main jet stream flow path is formed in such a manner that the main jet stream passing through the annular protrusion 61 (i.e., the acceleration flow path) of the metal stopper 6 becomes a turbulent flow. The main jet stream that is accelerated and becomes a turbulent flow is sprayed onto the inner peripheral surface of the chuck ring 3 and the front end part of the chuck 2 moves forward. Consequently, the front end part of the chuck 2 and the inner peripheral surface of the chuck ring 3 can be cleaned by the main jet stream that is accelerated and becomes a turbulent flow. The chuck 2 and the chuck ring 3 that are cleaned by the main jet stream that is accelerated and becomes a turbulent flow, can chuck the writing lead W with higher reliability than before.

The outer peripheral surface 21 of the chuck 2 of the present exemplary embodiment is formed into a tapered shape in which the outer diameter of a rear end of the outer peripheral surface of the chuck 2 is smaller than the outer diameter of a front end of the outer peripheral surface of the chuck 2. The inner peripheral surface 31 of the chuck ring 3 is similarly formed into a tapered shape in which the inner diameter of a rear end of the inner peripheral surface of the chuck ring 3 is smaller than the inner diameter of a front end of the inner peripheral surface of the chuck ring 3. The chuck 2 and the chuck ring 3 are configured to come into surface-contact with each other by fitting surfaces 21, 31 inclined with respect to the axial direction (refer to FIG. 2.) For this reason, the chuck 2 and the chuck ring 3 can chuck the writing lead W by being strongly fitted to each other. Furthermore, when the main jet stream that is accelerated in the axial direction and becomes a turbulent flow is sprayed onto the fitting surfaces of the chuck 2 and the chuck ring 3, the fitting surfaces that are inclined with respect to the axial direction can be cleaned efficiently by the main jet stream. Thus, the chuck 2 and the chuck ring 3 that are cleaned efficiently by the main jet stream can chuck the writing lead W with higher reliability than before.

The inner diameter of the tubular writing lead holder 5 of the present exemplary embodiment is configured to become large toward the rear. According to this configuration, the inner peripheral surface 51 of the writing lead holder 5 (refer to FIG. 2) that is inclined with respect to the axial direction can be cleaned efficiently by the main jet stream that is accelerated and becomes a turbulent flow. Since the area of a rear end surface of the writing lead holder 5 can be reduced, dust such as debris from the writing lead W can be prevented from adhering to the rear end surface of the writing lead holder 5. The writing lead holder 5 can also prevent the entry of a foreign matter from the outside of a tip opening of the tip fitting 73 of the shaft tube 7.

In the mechanical pencil 1, the click operation on the click button 9 performed by the user feeds the writing lead W forward, blows forward the foreign matter that has entered from the outside of the tip opening of the tip fitting 73 of the shaft tube 7 and dust generated therein such as debris of the writing lead W, and discharges the foreign matter and dust to the outside of the tip opening of the tip fitting 73 of the shaft tube 7. In this mechanical pencil 1, when the click operation is performed, the main jet stream flowing forward cleans an internal mechanism of the mechanical pencil 1. The mechanical pencil 1, therefore, can chuck the writing lead W with higher reliability than before. The mechanical pencil 1 can chuck the writing lead W with a high reliability even when used in an outdoor environment such as a building site and a construction site having a lot of foreign objects.

In an exemplary embodiment, when the user removes the writing lead and performs the click operation on the click button, the main jet stream that is accelerated and becomes a turbulent flow is ejected to the outside from the tip opening of the tip fitting of the mechanical pencil. According to this configuration, the user can clean an operation mechanism of the mechanical pencil by repeatedly executing the click operation multiple times.

The foregoing plurality of embodiments have described that the click button 9 is disposed at the rear end of the mechanical pencil 1. In another exemplary embodiment, however, the click button may be disposed on a side surface of the shaft tube of the mechanical pencil. Alternatively, in yet another exemplary embodiment, the mechanical pencil may be configured in such a manner that a click operation for moving the chuck forward is performed by relatively rotating the front tube and the rear tube of the mechanical pencil in the circumferential direction. The foregoing plurality of exemplary embodiments have described that the annular protrusion 61 forming the acceleration flow path is configured to protrude radially inward. However, in another exemplary embodiment, the annular protrusion 61 forming the acceleration flow path may be configured to protrude radially outward.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Exemplary embodiments of this invention are described herein, including the best mode known to the inventors for carrying out the invention. Variations of those exemplary embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The exemplary invention is not limited to the exemplary embodiments detailed above. The specific configuration of each portion can be modified within the range not departing from the purpose of the exemplary invention.

The descriptions of the various exemplary embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Further, Applicant's intent is to encompass the equivalents of all claim elements, and no amendment to any claim of the present application should be construed as a disclaimer of any interest in or right to an equivalent of any element or feature of the amended claim.

What is claimed is:

1. A mechanical pencil, including:

a writing lead;

a chuck that chucks the writing lead and feeds the writing lead forward;

a click button for feeding the chuck forward;

a chuck spring that urges the chuck rearward, and a metal stopper that comes into abutment with the chuck spring;

a shaft tube for housing the writing lead and the chuck, wherein, when a click operation for feeding the chuck forward is performed, a jet stream flowing forward is generated inside the shaft tube, wherein at least apart of the shaft tube includes a metal material, and the metal stopper is integrally fixed to the part of the shaft tube that includes the metal material, by a swaging processing in which the part of the shaft tube and the metal stopper are pressed together radially inward from an outer peripheral surface of the part of the shaft tube; and in a vicinity of the chuck, an acceleration flow path in which a flow path of the jet stream is narrowed, wherein the acceleration flow path is formed by the swaging processing.

2. The mechanical pencil according to claim 1, wherein the click button is assembled on the shaft tube, and a spacer for enhancing airtightness between the click button and the shaft tube is provided.

3. The mechanical pencil according to claim 1, further including, adjacent the chuck, a protrusion protruding in a radial direction, in which the jet stream becomes a turbulent flow.

4. The mechanical pencil according to claim 1, wherein the swaging processing is performed over an entire circumference of the shaft tube in a circumferential direction thereof.

5. The mechanical pencil according to claim 1, further including, behind the chuck, a protrusion protruding in a radial direction, in which the jet stream becomes a turbulent flow, wherein the protrusion is formed by the swaging processing.

6. The mechanical pencil according to claim 1, further including a chuck ring that is fitted to the chuck, wherein the chuck and the chuck ring come into a surface-contact with each other by fitting surfaces inclined with respect to an axial direction.

7. The mechanical pencil according to claim 1, further including a substantially tubular writing lead holder that holds the writing lead, wherein an inner diameter of the writing lead holder is configured to become large toward a rear.

8. The mechanical pencil according to claim 1, further including a spacer disposed on a rear end part of a rear tube of the shaft tube, wherein the spacer includes a diaphragm having an inner diameter less than inner diameters of remaining portions of the spacer to provide a flow path for the jet stream.

9. The mechanical pencil according to claim 8, wherein the spacer further includes a seal protruding radially outward at a rear end portion of the spacer, the seal abutting a rear end surface of a rear tube of the shaft tube.

10. The mechanical pencil according to claim 9, further including:

a first chamber confined by the seal, an outer tube of the click button, an inner tube of the click button, and a rear wall of the click button, wherein, after a click operation, the click button moves forward to generate the jet stream inside the first chamber.

11. The mechanical pencil according to claim 10, further including:

a writing lead tube, an outer peripheral surface of a rear end of the chuck being contacting an inner peripheral surface of a front end of the writing lead tube; and a second chamber confined by a rear end surface of the diaphragm of the spacer, an outer peripheral surface of the writing lead tube, and a front end surface of the inner tube of the click button, wherein the jet stream ejected from the first chamber flows into the second chamber, such that a volume of the second chamber reduces after the click button moves forward.

12. The mechanical pencil according to claim 8, further including a writing lead tube, an outer peripheral surface of a rear end of the chuck contacting an inner peripheral surface of a front end of the writing lead tube, wherein the flow path extends between an inner peripheral surface of the diaphragm and an outer peripheral surface of the writing lead tube.

13. The mechanical pencil according to claim 1, further including a chuck ring that is disposed between the chuck and the metal stopper.

14. The mechanical pencil according to claim 13, wherein, by moving forward the chuck and the chuck ring, a front surface of the chuck ring abuts a rear end surface of the shaft tube, and the chuck ring detaches from a rear end of the chuck.

15. The mechanical pencil according to claim 13, wherein a surface of the chuck contacts a surface of the chuck ring with respect to an axial direction.

16. The mechanical pencil according to claim 15, wherein the surface of the chuck is included from a front end of the chuck toward a rear end of the chuck, and wherein the surface of the chuck ring is included from a rear end of the chuck ring toward a front end of the chuck ring.

17. A mechanical pencil, including:

a writing lead;

a chuck that chucks the writing lead and feeds the writing lead forward;

a chuck spring that urges the chuck rearward, and a meal stopper that comes into abutment with the chuck spring;

a shaft tube for housing the writing lead and the chuck;

a spacer disposed on a rear end part of the shaft tube, wherein the spacer provides a flow path for a jet stream generated inside the shaft tube as the chuck is fed forward, wherein at least apart of the shaft tube includes a metal material, and the metal stopper is integrally fixed to the part of the shaft tube that includes the metal material, by a swaging processing in which the part of the shaft tube and the metal stopper are pressed together radially inward from an outer peripheral surface of the part of the shaft tube; and in a vicinity of the chuck, an acceleration flow path in which the flow path of the jet stream is narrowed, wherein the acceleration flow path is formed by the swaging processing.

* * * * *